United States Patent [19]

Charvat

[11] 4,128,972

[45] Dec. 12, 1978

[54] FLEXIBLE POLISHING WHEEL AND METHOD FOR PRODUCING SAME

[75] Inventor: Vernon K. Charvat, Bay Village, Ohio

[73] Assignee: The Osborn Manufacturing Corporation, Cleveland, Ohio

[21] Appl. No.: 567,775

[22] Filed: Apr. 14, 1975

[51] Int. Cl.[2] ..... C08G 51/12; C08G 51/14

[52] U.S. Cl. ..... 51/298 R; 51/295

[58] Field of Search ..... 51/295, 296, 298, 299

[56] References Cited

U.S. PATENT DOCUMENTS

| | | | |
|---|---|---|---|
| 2,885,276 | 5/1959 | Upton | 51/298 |
| 3,183,633 | 5/1965 | Decker | 51/298 |
| 3,252,775 | 5/1966 | Guilbert | 51/298 |
| 3,524,286 | 8/1970 | Wohrer | 51/298 |
| 3,661,544 | 5/1972 | Whitaker | 51/298 |
| 3,850,589 | 11/1974 | Charvat | 51/296 |
| 3,864,101 | 2/1975 | Charvat | 51/298 |
| 3,868,232 | 2/1975 | Sioui | 51/298 |

*Primary Examiner*—Donald J. Arnold
*Attorney, Agent, or Firm*—Maky, Renner, Otto & Boisselle

[57] ABSTRACT

Differentiation between grinding wheels which are dimensionally stable in use and which remove stock to specification tolerances and polishing wheels which are flexible and which primarily do not remove stock but which "fill the valleys with the hills" call for different development. This invention is directed to a polishing tool (wheel) comprising selected abrasive, filler and plastic elastomeric bond to produce a non-rigid solid tool (wheel) of minimum voids content, the cured elastomeric bond alone characterized by a Shore hardness of 45–55 but the completed tool face hardness is not in excess of about 96 "Shore A" hardness. The so limited polishing wheel is characterized by non-chattering, non-loading, aggressive and is yet non-smearing. It is arrived at by accurate volume control ratios of the components essentially present in the product.

9 Claims, No Drawings

FLEXIBLE POLISHING WHEEL AND METHOD FOR PRODUCING SAME

This invention is directed to a method for manufacture of an improved polishing wheel, which has an end use which is at a variance with grinding wheels. The differences will assist in understanding the improvement in the abrasive wheels of this invention over prior art grinding wheels.

A polishing wheel should be sufficiently flexible to deform under modest pressure. A grinding wheel should be rigid and its function is to remove stock from a work-piece to a standard specification, often to tolerances of the order of 0.0001 inch. Most often, a grinding wheel retains uniform dimension throughout its life.

A polishing wheel works on a surface already brought to a specification dimension. It is not intended to remove stock. One explanation of its function is to work on a surface, filling micro-valleys with material from adjacent micro-hills, thus eliminating surface imperfections as the adjective "polishing" implies. Prior art grinding wheels, using very fine abrasive grains or grit have been used as polishing wheels, but as the two have somewhat different functions, the older prior art polishing wheels still flourish. These wheels consist of a plurality of laminations of sheet fibrous material including canvas, leather, etc. disks mounted at their centers on a rotatable shaft. The outer periphery of these disks is coated with adhesive and then rolled into loose abrasive grain. The adherent grains act as abrading agents when moved over areas to be polished. Life of such devices is short, time to keep them operable expensive, and the need for improvement thereover great.

Attempts to use abrasive wheels primarily intended for grinding purposes for polishing lead to several objections. Because the working faces retain dimension, and remove excessive stock, loading of the work-face occurs. Some abrasive wheels "chatter" which defaces the area worked upon and decreases the efficiency of the operation. Attempts to soften "chattering" wheels has generally led to "ballooning" or loss of their integrity in use. When made less dense by reducing the abrasive content, they lose "aggressive" quality. Cellular elastomer bonds have been suggested to overcome heat build-up, but retaining wheel dimension has led to attempts to reinforce with fibrous material which has not been altogether successful.

First, it is convenient to explain conceptual aspects as the description of our preferred practice of the invention is hereinafter developed. The best mode of reduction to practice of the present invention is as follows.

One first determines the volume of the polishing wheel to be produced. This is also the volume of the mold cavity. The volume of the mold cavity is sometimes referred to herein as the true volume of the wheel. All calculations of interest in the following exposition have relation to the true volume of the ultimate wheel or mold cavity and correlatively the final product volume.

After selection of the quality of the abrasive to be employed, which depends on ultimate demands of the product, two variable factors become known. One is called the "bulk density". The bulk density, as the term is called in the abrasive art, varies with the selected grade, the particle diameter or particle shape and size, the size frequency analysis and other variables including the porosity of the abrasive particles themselves. The factors affecting the bulk density most markedly are the density of the abrasive material and the void volume or spaces between the adjacent particles of abrasive when they are in their densest packing arrangement. Practically, the bulk density is determined by allowing a dry sample of the selected abrasive grit to fall by free flow (like sand through an hour glass) into a standard volume and vibrated to remove excess abrasive over the standard volume of the container to achieve the densest packing arrangement. If the known true volume of a proposed polishing wheel mold cavity was so filled, the volume and weight could be readily converted to a bulk density value. Such value is sometimes referred to herein as "apparent abrasive volume" of the proposed polishing wheel.

The overall useful grade of abrasive may be classified for our present purposes from a 36 grit as a general useful upper limit of particle size all the way down to 600 grit, or the smaller flour sizes. The bulk density is also referred to in the art as "pack" density and "tap" density and may be expressed in the same terms as true density, e.g. as lbs. per cu. ft. or grams per cubic centimeter ($g/cm^3$).

Note, however, that the bulk density will always be less than the true density of the abrasive. This is due to interstitial void volumes and the volume of pores that may be present in each quality of abrasive particle and which will vary from grit to grit.

Both the bulk density and the true density may vary with the selected abrasive grit. Abrasive grits may be any one of the known abrasive materials including, but not limited to silicon carbide, sintered or fused aluminum oxide, emery, garnet, talc, pumice, coarse feldspar, rouge, etc., all of which may be used alone or in combination to produce polishing wheels of this invention. Abrasive polishing agents are well known and are not, per se, an inventive aspect of this specification. The other known factor pre-determined relative to the abrasive selected is the (true) density.

If it were possible to fill completely all the interstitial volume between the abrasive grains with a solid convertible liquid elastomer bond, the resultant abrasive wheel would be of maximum density, relatively hard, rigid and inflexible. A theoretical wheel thereby resulting would be very aggressive in character, probably load badly and would not generally be favorably designed for the ends of this invention.

To introduce correction and to avoid grinding wheel development, there is introduced a novel concept herein referred to as the "performance factor". The performance factor provides an accurate method for control of aggressive quality in a polishing wheel. The performance factor is always less than unity, and for purposes of this invention is never in excess of about 0.9 at which value the final polishing wheel is at its most aggressive level, least flexible, more inclined to load and about 0.9 provides an upper value. As the values assigned to the performance factor are successively reduced through the useful range from about 0.90, suggestively by amounts of the order of 0.02 to 0.05 to not less than 0.55, the wheel becomes more flexible, less aggressive and non-loading tendencies are improved. Experience has indicated an average aggressive polishing wheel is designed with a performance factor of about 0.60. As performance factors selected go progressively below 0.55 the tendency of the cured polishing wheel to smear the work surface increases rapidly and becomes objectionable.

Having determined the true volume of the final polishing wheel from the mold volume, and the apparent wheel volume from its bulk density, one can determine other design factors and limitations as are hereinafter developed, to define an advance in the art of producing polishing wheels.

The advance in the art of manufacture of improved polishing wheels as is disclosed herein has been materially assisted by a clear conception of limiting design factors not apparently recognized nor considered in the present state of the polishing wheel art.

The following concepts are helpful in understanding the best mode of practicing manufacture of polishing wheels within the scope hereof. To review, the true volume is the volume of the mold which is also the volume of the final tool. The apparent volume is the volume of dry abrasive just filling the true volume of the mold and corresponds with a state defining the bulk density of a selected abrasive. The apparent volume of abrasive includes the abrasive particles plus the interstitial volume between the abrasive grains and the gas volumes associated with porosity of the abrasive particles.

Multiplying the apparent volume of abrasive by the performance factor yields a volume figure which corresponds to the apparent design volume of abrasive. The apparent design volume of abrasive determines principally the aggressive quality of the wheel produced. If one multiplies the apparent design volume of abrasive by the bulk density of the abrasive selected, the true weight of abrasive required in the fluent mix to be used to fill the mold cavities can be determined. The true design volume of the abrasive (the volume occupied by the solid abrasive particles not including interstitial volumes or pore volumes) is determined by dividing the weight of abrasive required from the true design volume by the density of the selected abrasive. If one then subtracts the true design volume from the apparent design volume, one then knows the true void volume carried by the weight of selected grit. The weight of the selected abrasive thus determined is an essential part of the fluent mix formula used to fill the mold before curing or conversion of the elastomer bond liquid to a solid which reaction provides the solid integrity of the final product polishing wheel. Relationships between the above factors or concepts inherent in the above discussion have been found most useful to full understanding of the manufacture of the improved polishing wheel disclosed and will assist in understanding of the examples.

THE ELASTOMER BOND

By the term "elastomer bond" is meant the liquid organic adhesive materials (again not novel in and of themselves) which when mixed together in established proportions convert after reasonable times to form a solid coherent mass of marked tensile strength and cohesive bond to cement the inorganic particulate matter admixed therewith into an integral product. The use of elastomer bond materials in conjunction with abrasives is not broadly new in the abrasive wheel art for foamed elastomers as elastomer bonds have been heretofore suggested.

It has been discovered that several factors relating to the elastomer bond are critical to the manufacture of the improved polishing wheels of this invention, some of which factors preclude usefulness of some prior art resinoid binders heretofore suggested.

A principal factor has been found to be the hardness of the adhesive elastomer bond when converted to the solid form-giving final integrity to the polishing wheel. Heretofore, amine-aldehyde and phenol-formaldehyde adhesive bonds have been suggested as equivalent to other elastomer bonds in the art. It has been found that these adhesive bonding materials are too hard. Priorly, it was known that abrasive wheels could be made harder by increasing the volume of abrasive to volume of binder or adhesive elastomer bonding component ratios. However, the prior art has not, so far as known, recognized that for polishing purposes the cured hardness of the elastomer bond must fall within critical limitations. It has been found the quality of the cured adhesive plastic or elastomeric bond without abrasive loading should not exceed about 60 Shore hardness on the "A" scale, nor can it be less than about 50.

Additionally, it has also been found that when loaded with abrasive and filler, and cured in polishing tool form, the Shore hardness of the polishing product on the same scale should not exceed about 95. We prefer final Shore hardness values of the completed wheel to be within the range of 90 ± 5. Preferably, the adhesive elastomer bond when cured without loading may have a permitted Shore hardness of 55 ± 5. If the unloaded adhesive elastomer bond is loaded with excessive volumes of abrasive grit, then the cured hardness of the final polishing wheel will exceed the 95 Shore hardness limition. Excessive stock removal of the wheel becomes objectionable, loading problems increase, the wheel becomes too aggressive for polishing purposes, "chattering" becomes a source of complaint, and resiliency or flexibility is lost. On the other hand, if the ratio of volume of abrasive to volume of adhesive elastomer bond is too low the wheel becomes less effectual in polishing, wears out rapidly losing the wheel contour originally embodied and is likely to "balloon" or lose dimension under rotational forces.

The volume of adhesive elastomer bond is quite critical, as can be seen from the above, and the organic elastomer bond volume should not be less than about 40%, essential to sound wheel strength and integrity under rotational loads and loading in use, nor more than about 55%, as smearing of the work piece surface begins to reduce the desirable combination of qualities these express limits encompass.

The chemical nature of the adhesive elastomer bond is material only insofar as it is reflected in the physical qualities of the final product. Naturally, some liquid combinations when converted to solids produce better overall polishing wheels than others even though they may have the required physical specifications insisted upon herein as material to polishing wheels within this invention.

The presence of foam in the final polishing wheel is unwanted. It is known that gas cells assist in cooling abrasive wheels through better heat transfer, but void cells lessen the physical integrity of the wheel, distortion and ballooning are more often experienced and the cohesive forces holding the unit abrasive grains in the tool and together are materially weakened. Thus, the presence of foaming agents in the adhesive elastomer bond are to be avoided. The weaknesses of foamed abrading wheels has been heretofore recognized in the prior patent art.

A preferred class of adhesive elastomer bond embraces the polyurethanes, many of which are presently commercially available as two package liquids which are co-blended just before use and have a pot-life of several hours before converting from liquids to solids at usual ambient temperatures.

It is well known that polyurethane polymer precursors will foam with the presence of any moisture. Therefore, due precautions are to be exercised that no moisture be introduced into the liquid polyurethane precursor components either before or after intermixing with the inorganic particulates and just prior to filling the mold cavities to produce the polishing wheel (tool) products. Additionally, all mixing of polishing wheel components must be carried forward with great care that agitation itself, does not introduce air or other gas or moisture which will form pockets or gas voids or cells in the admixture. Flushing all volumes to be used for mixing purposes with dry nitrogen gas is a known expedient for keeping water vapor from being entrained in the admixtures. Storage of dry stocks in low humidity atmospheres is useful. Drawing a vacuum over mixed components is also a beneficial procedure to remove occluded gases in the mold mixes, particularly after placement in the mold cavity.

The art is replete on the chemistry of polyurethane precursor components, but in general it is known to use from about 0.9 to in excess of 1.5 equivalents of selected diisocyanate with one equivalent of a dihydroxy terminated polyester or polyether whose molecular weight is above about 500 to 4000. It is common to use stoichiometric excesses of the diisocyanate component to provide required curing. Other catalysts are known including organic peroxides. Trifunctional components, except for small control amounts are to be avoided. Plasticizers, including octyl alcohol terminated polypropylene adipates of 2000 to 5000 molecular weight from 2 to 20% have been used to soften polyurethanes and may be used in some instances with advantage. Small quantities of epoxides such as the monomeric diglycidyl ether of bisphenol "A" have also been incorporated in polyurethanes to increase their temperature resistance.

Certain polyepoxide resins have also been used having a Shore hardness within the defined limits. A two part epoxy casting compound Part A of which is a fairly low molecular weight epoxy material (sold as Epocast* X-87457-A) containing flexibility component is mixed 100 parts with 10 parts of a yellow hardener (Epocast* X-87457-B) which is believed to be principally an organic peroxide. When mixed the liquid mixture has a pot life of about 20 minutes and will cure in 24 hours at 75° F. or can be heated at 150° F. to accelerate curing. *(Products of Furane Plastic Incorporated of New Jersey.)

Density of the useful polymers constituting the elastomer bond have been from above 60 lbs./cu. ft. but less than 70 lbs./cu. ft. Preferred elastomer bonding blends are fluent when mixed with required quantities of particulate solids, e.g. abrasive grit and inorganic inert fillers. Those which cure at room temperature (70°–100° F.) are advantageous. Pot-life should be not less than about 15 to 20 minutes to avoid difficulty in production.

THE FILLER COMPONENT

Experience has indicated that the presence of voids materially reduces the integrity of the final polishing wheel. As reviewed above, the interstitial space contributes materially to gas cells or voids in the cured wheel. Also, where the volume of elastomer bond approaches the upper limits of volume proportion in the product wheel there may be unsatisfied volume remaining in the calculated true volume of the wheel. It is practically impossible from a production point of view to displace 100% of the calculated void volume. It has always been possible to find a small percentage of gas cells in burn out analysis, but effort is consistent to keep the volume of gas cells at a minimum to obtain maximum wheel strength.

This is done in part by the inclusion of inert fillers of a particulate, solid nature, preferably inorganic of light density and of pigmentary particle size range or less than about 10 microns average particle diameter passing through a 400 mesh screen. In any event, the true volume of filler employed will always be less than 15% of the true volume of the tool. Void volume is preferably calculated to be less than 5% of the true volume, for at about 10% voids and above, wheel strength continues to decrease with increasing void content.

Having discussed the formulation and wheel design both generally and in some detail, the following first example illustrates manufacture of a production batch of cone shaped wheels having a 7.72 cm. O.D. by 2.54 cm. high having a true volume of 75.6 $cm^3$ made in production molds grossly resembling cupcake pans having 20 cavities per mold. Each individual mold is fitted with a spring loaded center plunger pin which is used to force the final polishing wheel when cured from the mold volume. The density of the selected abrasive is 3.95g/$cm^3$. The density of the cured elastomer bond is not less than about 1.1g/$cm^3$. The glass microsphere filler selected has a density of 0.6g/$cm^3$ and passes completely through a 400 mesh standard screen.

EXAMPLE I

A flowable mixture is prepared which allows about 8% volume overage to fill 20 mold cavities as follows:

457 g of a commercial liquid polyester resin (*Uralane 8059-A)

343 g of a commercial liquid diisocyanate (*Uralane 8059-B) are slowly mixed together with about 8 drops of a silicone defoaming agent, to which liquid is added slowly 1800 g Aluminum oxide 46 grit abrasive powder (Norton Aluminum)

100 g glass micropheres ("Armospheres")

The batch is carefully stirred to homogeneity, care being taken not to stir in air, with a dough mixer loop. A vacuum is preferably drawn over the mixture to remove any air cells prior to filling molds. The mixture is then poured into the mold cavity and struck allowing a very slight overfill.

After filling the mold cavities, the "cupcake" embryo polishing wheels are allowed to stand several hours at room temperature to allow any gas cells to rise out to the surface. Any excess material is again struck before covering the mold cavity and a polypropylene brush has been found a useful tool to break bubbles floating to the surface. A heavy "Teflon" sheet is placed over the top of the mold cavity, followed by a rubber sheet. Two molds so filled are placed so the open tops of the molds are facing and the two molds clamped face-to-face together. Excess volume, if any, flashes between the mold faces.

While the curing can be accomplished at room temperature, preferred practice is to heat the mold pair at 150° F. for 2 hours.

The molds are taken apart and the individual mold cavities emptied of the cured products by pressing the completed wheels outwardly from the cavity by means of the central spring-loaded plunger pins. The completed polishing wheels weighed 130 grams. Sample wheels were burned out (all combustibles volatilized) as is a standard method of analysis in the art. Analysis is tabulated as follows:

Abrasive weight/grams = 80.6

Abrasive weight percent $\frac{80.6}{130} = 62\%$

Abrasive true volume $\frac{(.62)(130)}{3.95} = 20.4\ cm^3$

Elastomer bond: weight/grams 39.0
percent by weight 30.0%
volume: (from wt) $\frac{(30)(130)}{1.1} = 35.45\ cm^3$
% by volume $= \frac{35.45}{75.6} = 46.9\%$ Filler: weight/grams = 10.4
weight percent = 8% volume $= \frac{10.4}{.6}\ 17.33 = cm^3$

Volume voids = 75.6−(20.4 + 35.45 + 17.33) = 75.6 − 73.2 = 2.4 $cm^3$ void volume Overall wheel density = 1.72 g/$cm^3$(abrasive + elastomer bond + filler) volume
Volume voids (wheel volume) = 2.4 $cm^3$
Wheel weight = 130.9
Wheel volume = 75.6 $cm^3$
Bulk density (grit) = 1.887g/$cm^3$ (average)
Theoretical or apparent abrasive weight = 142.6 grams Performance factor $\frac{\text{actual g. abrasive}}{\text{theoretical g. abrasive}} = \frac{80.6}{142.6} = .565$ Elastomer bond density (cured) = 1.1

Elastomer bond volume $= \frac{39}{1.1} = 35.45\ cm^3$

% by volume elastomer bond $\frac{35.45}{75.6} = 46.9\%$

In Example I, the shop formula and method of manufacture have been set out, along with an analysis of the critical factors relating to the polishing wheel design made by the destructive burn out method. It is the relationships between the factors shown in the analysis that give rise to the development of polishing wheels that makes possible tools that do not chatter, smear, balloon nor load up and which have the essential integrity to stand heavy schedules of use without losing their integrity nor wearing out rapidly.

In the following Example II, a wheel is synthesized to show the means of arriving at useful formulations within the scope of the invention.

EXAMPLE II

In this example is illustrated the synthesis of a polishing wheel within the purview of this invention. A polishing wheel of radial design of relatively fine grit size is desired. The final product is to be 2¾ OD and 5/6" thickness. The true volume of the wheel and the mold cavity is 29.4 $cm^3$. The grit selected is a coarse abrasive feldspar which has a bulk density of 1.26 g/$cm^3$.

Volume of wheel x bulk density = grams of abrasive to fill cavity (29.4) (1.26) = 37.04 g (theory)

The wheel is to be designed to a performance factor = 0.872.

(37.04) (P.F.) = 37.04 × 0.872 = 32.3 g abrasive to be used in wheel.

Density of feldspar = 2.6 grams/$cm^3$.

$\frac{\text{weight abrasive}}{\text{density}} = \frac{32.3}{2.6}$ = true volume of abrasive = 12.43 $cm^3$ = true vol. of abrasive True volume % of abrasive wheel = $\frac{\text{True volume abrasive}}{\text{cavity volume}} = \frac{12.43}{29.40} = 42.3\%$ A polishing wheel of intermediate bond content is desired. An elastomer bond level for the particular abrasive selected was set at 48.5% elastomer bond volume.

The true abrasive volume % $= \frac{12.43}{29.4} = 42.3\%$

The elastomer bond volume = (48.5%) = 48.5%
(48.5%) (true wheel volume = (.485) (29.4$cm^3$)
Elastomer bond volume = 14.26 $cm^3$
True volume of abrasive = 12.43 $cm^3$
Total solids volume = 26.69 $cm^3$
Total wheel volume = 29.40 $cm^3$
Total voids volume = 2.70 $cm^3$ Thus, after filling some of the interstitial abrasives volume with elastomer bond, there is still in theory 2.71 $cm^3$ of voids not filled. Assuming 50% of this volume to be filled with filler, then 2.71 $cm^3$ ÷ 2 = 1.35 $cm^3$ × 0.6 = 0.81 g filler per wheel are used.

The percentage of voids volume in the wheel is then 100 × (1.35/29.4) = 4.6% voids volume and 100 × 1.35/29.4 = 4.6% filler volume.

The percentage of true abrasive volume = 12.43/29.4 × 100 = 42.3% abrasive volume.

The percentage of elastomer bond volume = 48.5% by design selection (to suit the work to be done).

The following table summarizes the calculations relative to the wheel.

| | Weight/gram | Weight Percent | Volume $cm^3$ | Volume Percent |
|---|---|---|---|---|
| Abrasive | 32.3 g | 66.5 | 12.43 | 42.3 |
| Elastomer Bond | 15.7 g | 32.6 | 14.26 | 48.5 |
| Theoretical Voids | — | — | 2.7 | 9.2 |
| Filled Voids | — | — | 1.35 | — |
| Filler Used | .81 g | 1.60 | 1.35 | 1.68 |
| Theoretical Remaining Voids | — | — | 1.35 | 4.7 |

The true weight of the wheel is 48 grams, thus assuming a 30 cavity mold and an 8% excess one would make up the following mixture 1046 g abrasive, 509 g elastomer bond and 24.3 g filler. A rather simple formula from some rather complex considerations.

The wheel produced from the above design was found to be substantially free from objectionable loading, chatter and smear in use and to have good integrity under loading.

The two examples above are believed to illustrate both analysis and synthesis of actual wheels found acceptable in the field.

Except for the polishing wheels of the present invention, those available suffer from one or more of the defects outlined above. It is believed that the success of the present polishing wheel has been brought about by close control of volumes and volume ratios of components, all having direct relationship with the final qualities desired in the product polishing wheel, taking into account the work to be performed.

Having illustrated the best mode of practicing the invention presently known, I claim:

1. An abrasive polishing wheel having a "Shore A" hardness of less than 96 and comprising, (a) an abrasive grain in an amount of from about 55 to about 90% of the theoretical weight of grain required to fill the volume occupied by the wheel, (b) from about 40% to about 55% by volume of an elastomer bond, said elastomer having an unfilled cured "Shore A" hardness of from about 50 to about 60 and a density of greater than 1 gram/cm$^3$, (c) from zero up to about less than 15% by volume of an inert filler having an average particle diameter of less than 10 microns, and (d) less than 10% by volume of voids.

2. The wheel of claim 1 wherein the "Shore A" hardness of the wheel is within the range of from about 85 to about 95.

3. The product of claim 1, where the elastomer bond is a non-foamed polyurethane resin.

4. The product of claim 1, where the elastomer bond is a non-foamed polyepoxide resin.

5. The product of claim 1, where the total voids in said wheel are less than about 5%.

6. A method for cavity molding a polishing wheel characterized by its freedom from loading, chattering and smearing which comprises: (1) determining the apparent volume of dry particulate abrasive grains essential to fill the wheel mold cavity under densest packing arrangement, (2) reducing the apparent volume of said abrasive grains by a factor of at least 0.1 but not more than 0.45, (3) mixing the reduced volume of abrasive grains with (4*a*) a mixture of organic liquids which react to form an essentially foam-free solid polymer, said solid polymer characterized by a (Shore A) hardness of more than 50 but not more than about 60 in a volume not more than about 55% and not less than 40% of said wheel mold cavity volume and (4*b*) a volume of particulate filler, said volume being less than the difference between said mold volume and the sum of the true volume of the adjusted abrasive plus the volume of the solid convertible liquids, but sufficient to reduce the total voids volume in the cured wheel to less than 15% of the mold volume, (5) filling the molds with the plastic mixture and (6) allowing the plastic mixture to convert to a solid polymeric form in the mold before removal.

7. The method of claim 6 where the organic liquids are selected to form foam-free polyurethane solid polymers.

8. The method of claim 6, where the organic liquids are selected to form foam-free polyepoxide solid polymers.

9. The process of claim 6, where the volume of particulate filler is sufficient to reduce the final voids volume content of the cured wheel to less than about 5%.

* * * * *